US005743279A

United States Patent [19]

Gueret

[11] Patent Number: 5,743,279

[45] Date of Patent: Apr. 28, 1998

[54] PACKAGING UNIT FOR A PRODUCT SUCH AS MASCARA

[75] Inventor: Jean-Louis H. Gueret, Paris, France

[73] Assignee: L'Oreal, Paris, France

[21] Appl. No.: 705,653

[22] Filed: Aug. 30, 1996

[30] Foreign Application Priority Data

Aug. 30, 1995 [FR] France ..... 95 10230

[51] Int. Cl.[6] ..... A45D 40/26

[52] U.S. Cl. ..... 132/218; 132/317; 132/320; 401/129; 401/122; 206/581; 206/823

[58] Field of Search ..... 132/218, 216, 132/317, 313, 320; 15/207.2, DIG. 5, 160, 172; 401/129, 122, 128; 206/581, 823

[56] References Cited

U.S. PATENT DOCUMENTS

| | | | |
|---|---|---|---|
| 2,271,034 | 1/1942 | Pithie . | |
| 3,549,266 | 12/1970 | Vasas | 132/218 |
| 4,135,527 | 1/1979 | Montiel | 132/216 |
| 4,627,125 | 12/1986 | Gruns | 15/160 |
| 4,889,228 | 12/1989 | Gueret | 401/122 |
| 5,137,387 | 8/1992 | Byrd et al. | 401/122 |

FOREIGN PATENT DOCUMENTS

| | | | |
|---|---|---|---|
| 677456 | 10/1995 | European Pat. Off. | 401/122 |
| A-0-627 182 | 12/1996 | European Pat. Off. . | |
| A-1 070 381 | 7/1954 | France . | |
| A-2 330 353 | 6/1977 | France . | |
| 2564712 | 11/1985 | France | 132/218 |
| A-2 564 712 | 11/1985 | France . | |
| B-11 72 583 | 2/1959 | Germany . | |
| WO-A-95 11839 | 5/1995 | WIPO . | |

*Primary Examiner*—Gene Mancene
*Assistant Examiner*—Philogene Pedro
*Attorney, Agent, or Firm*—Oblon, Spivak, McClelland, Maier & Neustadt, P.C.

[57] ABSTRACT

A packaging unit for a product such as mascara includes an applicator and a reservoir provided with at least one wiper. The applicator has a handle and at least one tuft of bristles implanted parallel to the median plane of this handle. The wiper is arranged so as to wipe the bristled part along the axis of the bristles.

19 Claims, 1 Drawing Sheet

PACKAGING UNIT FOR A PRODUCT SUCH AS MASCARA

BACKGROUND OF THE INVENTION

1. Field of the Invention

The invention concerns a packaging unit for a liquid to pasty make-up product such as mascara, comprising an applicator and a reservoir provided with at least one wiper. More particularly, the applicator comprises a handle supporting at least one tuft of bristles, these bristles being of a specific shape and length and capable of applying mascara to keratinous fibers, and eyelashes in particular.

2. Description of the Related Art

Many devices have been proposed for the application and packaging of mascara. They generally comprise a rigid tubular body, open at one end, containing the make-up product, and an applicator capable of being accommodated in this body and provided with a stem ending in a brush. A wiper accommodated in the body wipes the brush and/or the stem as the applicator is withdrawn from the body. However, one of the drawbacks encountered in use of such devices that the applicator behaves like a piston during its displacement in the body, thus creating a disagreeable suction noise due to the sudden return of the interior of the body to atmospheric pressure.

When the make-up product is fluid, the wiper comprises a constricted portion so as to effect the wiping of the stem and the brush. This prevents there being left on the stem a quantity of the product which could, during the use of the brush, come to flow onto the stopper of the applicator and thus foul the thread of the applicator which is intended for fixing the stopper on the body. This constricted portion increases the intensity of the emitted sucking noise. Moreover, as the applicator is being withdrawn, a quantity of the mascara resulting from the wiping of the stem is accumulated at the periphery of the constricted portion of the wiper and forms an accumulation which is splattered by a Venturi effect towards the end of the brush when the air suddenly enters the body. Of course, as far as the user is concerned this splattering of the mascara at the end of the brush constitutes a nuisance and a loss of the product.

Another drawback in the known application and packaging devices is the shearing of the formula of the mascara during the wiping of the brush in the way described above. Indeed, in such devices the wiping action breaks the formula of the mascara since it is effected perpendicularly to the bristles of the brush; the formula is subjected to a variation in viscosity; it may form clumps performing a poor smoothing of the eyelashes. This is, in particular, the case with mascaras having a high pigmentary charge. The existence of this phenomenon necessitates the use of compositions that are not susceptible to shearing and limits the choice of the mascara compositions that can be used.

There thus remains the need for a packaging unit for mascara, whose product losses due to the splattering of mascara during the withdrawal of the applicator will be prevented and wherein the wiping does not shear the formula.

SUMMARY OF THE INVENTION

It is an object of the present invention to provide a packaging unit without product losses due to splattering during the withdrawal of the applicator and wherein the wiping does not shear the product.

The invention thus provides a new packaging unit for a liquid to pasty product such as mascara, comprising a product reservoir provided with a wiper and an applicator provided with a flat handle and with a bristly part comprising bristles, the applicator being capable of closing the reservoir, wherein the wiper shape is complementary to the bristly part and wherein the wiper is arranged so as to wipe the bristles along their longitudinal axes.

Advantageously, the bristles or the bristly part has at least one tuft of bristles implanted parallel to the plane of the handle of the applicator. The width of the free end of the tuft of bristles, measured along a first direction parallel to this plane, is at least equal to a quarter of an arc formed from the eyelashes, the bristles being capable of applying the product to the keratinous fibers along an axis, preferably the longitudinal axis, of the lashes. That is, its width is at least a quarter of the arc formed by the eyelashes of the eye having the mascara applied thereto.

The product which is to be applied with the applicator of the invention can be any liquid to pasty product, like pigments and/or fillers comprising fluids, and particularly hair dye or mascara. Keratinous fibers can be eye lashes, eyebrows, hair or bristles.

Advantageously, the wiper is matched to the shape of the part with bristles so as to wipe these bristles parallel to their longitudinal axis when the applicator is being extracted, thus avoiding the shearing of the formula. The wiper may be fixed in the reservoir. This configuration also makes it possible to avoid the sucking noise as the applicator is being withdrawn.

Advantageously, the unit comprises means for creating low pressure inside the reservoir when the applicator is being withdrawn so as to load the bristles with product such as mascara. Thus the wiper and/or the handle may have reliefs. The wiper can also be made of a foam provided with a slit. Or the reservoir may have a flexible pouch containing the mascara. In this special case, the wiper may be molded together with the head of the flexible pouch, thus ensuring a better loading of the bristles with mascara. Indeed, the withdrawal of the applicator produces inside the flexible pouch a low pressure which applies the walls of this pouch against the bristles of the applicator, and therefore loads the applicator with mascara. The applicator is washable.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
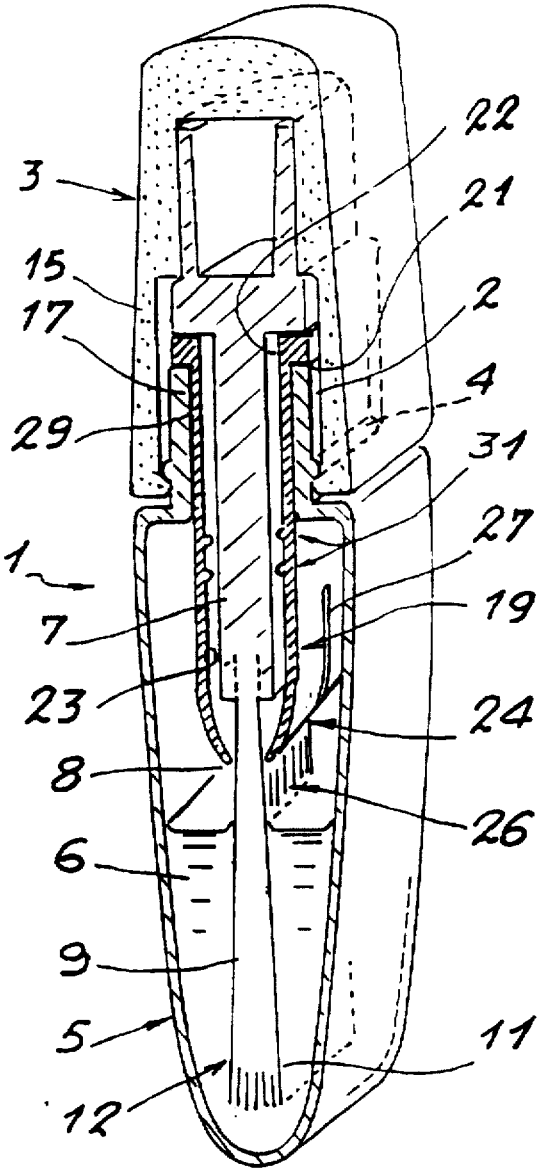
FIG. 1 is a sectional view in perspective of the packaging unit in accordance with the invention.

According to the embodiment illustrated in FIG. 1, the packaging unit 1 in accordance with the invention comprises an applicator 3 and a reservoir 5 for make-up product 6, in this case mascara. In comparison to those of the prior art, this unit is extra flat. The applicator 3 is provided with a flat, planar handle 7 and an extra flat part 9 with bristles, which is directly fixed to the handle in parallel to the plane of the handle. The bristled part 9 is constituted by several aligned tufts 12 of bristles, it being possible for the bristles 11 to have different lengths, shapes, diameters, cross-sections and characteristics depending on the loading, low or high, which is intended to be applied to the keratinous fibers. Thus the adjustment of the loading is made at the bristles, depending on the configuration and nature of the bristles. These bristles have a diameter generally ranging from 0.02 to 1.5 mm. At least one portion of the bristled part 9 dips into the mascara. The bristled part 9 has an overall length effective to ensure an optimum loading of the keratinous fibers and in particular of the eyelashes. In particular, this length ranges from 4 to 60 mm, preferably from 5 to 40 mm.

The handle 7 is mounted on a cap 15 which serves as a lid and which is capable of being catch engaged (groove 2-bead 4) on the reservoir 5. This reservoir 5 has a neck 17 whose internal wall 29 is provided with a wiper 19, one end 22 of which situated opposite the cap 15, is fixed on the neck 17. In another embodiment of the invention, this end 22 can bear on the neck 17 of the reservoir 5. At the end 22 of the wiper, the handle 7 has a sealing system which may be a gasket 21 as shown in this figure, or which may be a washer bearing on a flange. On the opposite end to its fixed end 22, the wiper 19 has a free end 24 having an opening 8 of oblong shape, or in the form of a flattened ellipse, and whose major dimension is orientated along the first direction defined above, so as to smooth the bristles along their axis as the applicator is being withdrawn and so as to regulate the filling of the interstices by the product between the bristles. The free end 24 of the wiper may also have a sealing system that can be used on its own or together with the sealing system 21 of the handle. The internal wall 23 may have reliefs 31 in order to create a low pressure in the reservoir when the applicator is being withdrawn. This configuration of the bristled part and the wiper prevents the unpleasant suction noise and the splattering of the product observed with known packaging units. The wiper may be of a rigid or semi-rigid material, this material being preferably chosen from elastomers or thermoplastic materials.

The reservoir 5 may be a tube of flexible material. The user can then adjust the wiping by a simple pressure on the reservoir at the wiper. This can be aided by one or several longitudinal slots 27 cut into the wiper along the longitudinal axis of the bristles.

Figure 4:
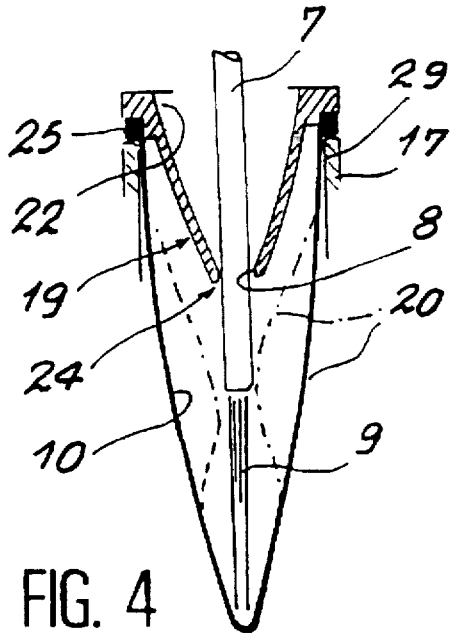
FIG. 4 is a sectional view of the flexible pouch contained in the reservoir, before and after the applicator has been withdrawn.

In the embodiment of this FIG. 1, the packaging unit is closed and the opening 8 of the wiper is situated around the fixed end 26 of the bristled part. It is also possible to position this opening 8 around the handle 7, as shown in FIG. 4. A portion of the handle 7 then dips into the reservoir 5. In this case, the wiper must be shaped according to the shape of the handle to ensure the wiping of the handle and of the bristled part 9, always in the longitudinal direction of the bristles 11, as the applicator is withdrawn. The bristled part has, in this case, a thickness that is substantially equal to that of the handle.

Figure 5:
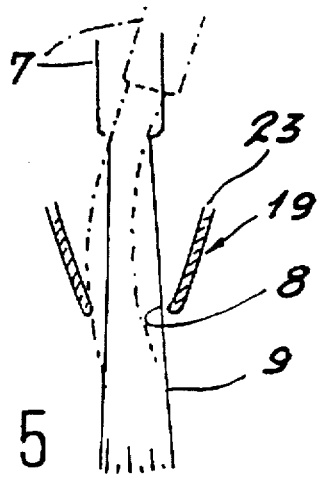
FIG. 5 shows the wiping of the end of the bristles.

In practice, when the user withdraws the applicator 3 from the reservoir 5, the wiping of the bristles 11 is produced at the opening 8 of the end 24 of the wiper 19. By being effected parallel to the longitudinal axis of the bristles, this wiping does not shear the formula of the mascara. On completion of the extraction of the applicator, the user slightly inclines the applicator, and the ends of the bristles are automatically wiped by rubbing the bristles along the internal wall of the wiper or at the edge of the opening of the wiper, as shown in FIG. 5. To facilitate the extraction, a portion of the handle may be flexible. Such a packaging unit thus makes it possible to use compositions that are generally susceptible to the shearing phenomenon, and thus makes it possible to use new mascara formulations.

Figure 2:
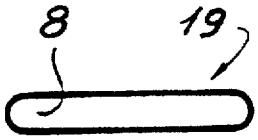
FIG. 2 is a sectional view of the wiper of the unit of FIG. 1.

In FIG. 2 there is shown a detail of the wiper opening 8 of an oblong shape to fit the applicator. Such a wiper may be used for a heavy loading of mascara.

Figure 3A:
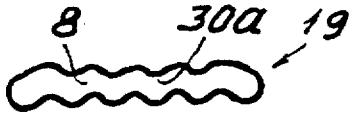
FIG. 3*a* is a view in cross-section of a variant of the wiper of FIG. 1, having denticulations.
Figure 3B:
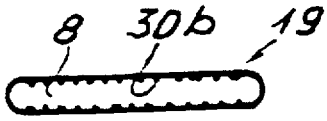
FIG. 3*b* is a view in cross-section of a variant of the wiper of the unit of FIG. 1, the wiper here being flocked.

The wiper can be provided with reliefs on its opening 8. In particular, it can be provided with denticulations **30*a*, as shown in FIG. 3*a*. In another embodiment of the invention shown in FIG. 3*b*, the wiper may be flocked. Its internal wall is then provided with small particles 30*b*** due to the flocking. Such wipers are used for obtaining a light loading of the bristles and hence of the keratinous fibers.

According to a preferred embodiment of the invention, the mascara may be contained in a flexible pouch 20 shown in FIG. 4 and having an opening 25. The opening 25 has a cross-section equal to the internal cross-section of the neck 17 of the reservoir, the edge of this opening 25 being positioned between the internal wall 29 of the neck 17 and the end 22 of the wiper 19. The end 24 of the wiper 19 is situated inside the internal flexible pouch 20. The dot-dash lines show the position of the flexible pouch 20 just as the applicator starts to be withdrawn. Due to the low pressure, the walls 10 of the flexible pouch are then drawn in and adhere along the bristled part 9 so that it is thus loaded with mascara which is spread over the bristled part 9 by the internal walls 10 of the flexible pouch 20. During the withdrawal of the applicator, this flexible pouch also prevents the accumulation of the product in the vicinity of the wiper due to the piston effect observed in the known packaging units. It thus prevents the clogging of the wiper.

Such a packaging unit for mascara is very easy to make: it can be made of any material generally used for the manufacture of cosmetic accessories. Since the applicator does not need a central metallic core, the packaging unit of the invention can be made solely from organic materials, and in particular solely of plastic materials, and be therefore completely recyclable.

Obviously, numerous modifications and variations of the present invention are possible in light of the above teachings. It is therefore to be understood that the invention may be practiced otherwise than as specifically described herein.

What is claimed:

1. A packaging unit for a liquid to pasty product to be applied to keratinous fibers, comprising:

a reservoir for the product and provided with a wiper; and an applicator having a planar handle and a bristly part having bristles, said applicator being mountable on said reservoir for closing said reservoir, wherein said wiper has a shape complementary to that of said bristly part, wherein said wiper is positioned so as to wipe the bristles along their longitudinal axes, and wherein said bristly part has at least one tuft of bristles implanted parallel to the plane of the handle.

2. A packaging unit according to claim 1, wherein a width of the free end of the tuft of bristles, measured along a first direction parallel to the plane, is at least equal to a quarter of an arc formed of the fibers, the bristles being capable of applying the product to the keratinous fibers along a longitudinal axis of the fibers.

3. A packaging unit according to claim 1 including means for preventing the clogging of the wiper.

4. A packaging unit according to claim 3 wherein said clogging preventing means comprises a flexible pouch contained in the reservoir, said flexible pouch containing the product.

5. A packaging unit according to claim 1 wherein said wiper is flocked.

6. A packaging unit according to claim 1 wherein said wiper is formed of a material chosen from elastomers and thermoplastic materials.

7. A packaging unit according to claim 1 wherein said part with bristles has an overall effective length capable of providing an optimum loading of the fibers.

8. A packaging unit according to claim 7 wherein the length of said part with bristles ranges from 5 to 40 mm.

9. A packaging unit according to claim 1 wherein said handle of the applicator is mounted on a cap capable of being catch-engaged on the reservoir.

10. A packaging unit according to claim 1 including means at said handle for sealing said reservoir.

11. A packaging unit according to claim 1 wherein said packaging unit is made solely of plastic materials.

12. A packaging unit according to claim 1 wherein said wiper comprises means for wiping ends of the bristles along an internal wall of the wiper during inclination of the applicator.

13. A packaging unit according to claim 1 wherein said product is mascara.

14. A packaging unit for a liquid to pasty product to be applied to keratinous fibers, comprising:

a reservoir for the product and provided with a wiper; and an applicator having a planar handle and a bristly part having bristles, said applicator—being mountable on said reservoir for closing said reservoir, wherein said wiper has a shape complementary to that of said bristly part and wherein said wiper is positioned so as to wipe the bristles along their longitudinal axes, including means for creating a low pressure in the reservoir during the removal of the applicator from this reservoir so that the bristles are loaded with the product.

15. A packaging unit according to claim 14 wherein said low pressure creating means include reliefs formed on an internal wall of the wiper.

16. A packaging unit for a liquid to pasty product to be applied to keratinous fibers, comprising:

a reservoir for the product and provided with a wiper; and an applicator having a planar handle and a bristly part having bristles, said applicator—being mountable on said reservoir for closing said reservoir, wherein said wiper has a shape complementary to that of said bristly part and wherein said wiper is positioned so as to wipe the bristles along their longitudinal axes, wherein said wiper has, in cross-section thereof in a plane perpendicular to a direction of movement of the handle during wiping, an oblong opening for the passage of the bristled part.

17. A packaging unit according to claim 16 wherein a fixed end of the part with bristles is situated in the vicinity of the opening of the wiper.

18. A packaging unit according to claim 16 wherein the wiper has reliefs at said opening.

19. A packaging unit for a liquid to pasty product to be applied to keratinous fibers, comprising:

a reservoir for the product and provided with a wiper; and an applicator having a planar handle and a bristly part having bristles, said applicator—being mountable on said reservoir for closing said reservoir, wherein said wiper has a shape complementary to that of said bristly part and wherein said wiper is positioned so as to wipe the bristles along their longitudinal axes, wherein said wiper has at least one longitudinal slot.

* * * * *